US007901334B2

(12) United States Patent
Chen et al.

(10) Patent No.: US 7,901,334 B2
(45) Date of Patent: Mar. 8, 2011

(54) EXERCISE APPARATUS WITH ADJUSTABLE RESISTANCE ASSEMBLY

(75) Inventors: Kuei-Sen Chen, Ta Ya Hsiang (TW); Joe Chen, Ta Ya Hsiang (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 49 days.

(21) Appl. No.: 12/291,402

(22) Filed: Nov. 12, 2008

(65) Prior Publication Data

US 2010/0009815 A1 Jan. 14, 2010

(51) Int. Cl.
*A63B 22/06* (2006.01)

(52) U.S. Cl. ..... 482/63

(58) Field of Classification Search ..... 482/57, 482/63, 64

See application file for complete search history.

(56) References Cited

U.S. PATENT DOCUMENTS 3,259,385 A * 7/1966 Boren ..... 482/60
6,099,440 A * 8/2000 Schurter et al. ..... 482/63
7,004,888 B1 * 2/2006 Weng ..... 482/57

FOREIGN PATENT DOCUMENTS

TW 00566168 12/2003

* cited by examiner

*Primary Examiner* — Fenn C. Mathew
*Assistant Examiner* — Andrew M Tecco

(57) ABSTRACT

The present invention relates to an exercise apparatus with an adjustable resistance assembly. The adjustable resistance assembly has a screw portion. An user can rotate an operating portion which is connected to one end of the screw portion to move the screw portion to drive a pushing portion toward a rotating member which is pivotally connected on the exercise apparatus. Simultaneously, the pushing portion drives an elastic member to cause deformation and make a friction surface of a resistance member which is connected on the elastic member gradually press the rotating member therefore increases friction resistance. When the user rotates the operating portion reversely, the screw portion is moved outward the rotating member and the elastic member recovered from the deformation thereby decreases the friction resistance relative to the rotating member.

10 Claims, 7 Drawing Sheets

EXERCISE APPARATUS WITH ADJUSTABLE RESISTANCE ASSEMBLY

CROSS-REFERENCE TO RELATED APPLICATION

This application claims priority of Taiwanese Invention Patent Application No. 097125989, filed on Jul. 8, 2008.

BACKGROUND

1. Field of the Invention

This invention relates to an exercise apparatus, more particularly to an exercise apparatus with an adjustable resistance assembly.

2. Description of the Related Art

FIG. 7 illustrates a prior stationary bicycle 80. The stationary bicycle 80 comprises a frame 81, a seat 82, a pedal mechanism 83 and a rotating member 84. A user can sit on the seat 82 and drive the pedal mechanism 83 to rotate the rotating member 84 for exercising with basic intensity. Besides, the user can operate an adjustable resistance assembly 90 which is configured on the frame 81 over the rotating member 84 to increase or decrease friction resistance which is exerted on the rotating member 84. The adjustable resistance assembly 90 can also be operated to immediately exert large friction resistance on the rotating member 84 to stop the rotating member 84 at short time.

Pleases refer to FIG. 8, the adjustable resistance assembly 90 comprises a guiding tube 86 approximately vertically mounted on the frame 81. From top to bottom, there are a screw rod 91, a medium spring 92 and a pushing lever 93 inside the guiding tube 86. The top end of the screw rod 91 is higher than the guiding tube 86 and outside of the guiding tube 86. A knob 94 is mounted on the top end of the screw rod 91. Inside the guiding tube 86, the screw rod 91 is threaded into a sliding unit 95. The sliding unit 95 can be moved in a limiting range but can not rotate. There is a recovering spring 96 inside the lower portion of the guiding tube 86. The pushing lever 93 runs through the recovering spring 96. The top end of the recovering spring 96 contacts the pushing lever 93 and the bottom end thereof contacts the frame 81. The bottom end of the pushing lever 93 is outside of the guiding tube 86 and connected to a front end of a lever unit 97. The rear end of the lever unit 97 is pivotally connected to the frame 81. There is a resistance member 98 pivotally connected to the central portion of the lever unit 97. The resistance member 98 has an arc friction surface 99 for contacting the rotating member 84.

According to the components relationship of the adjustable resistance assembly 90, the pushing lever 93 bears upthrust force from the recovering spring 96 all the time. And the screw rod 91 also bears the upthrust force from the medium spring 92 all the time. Therefore, the sliding unit 95 is maintained at the top position in general. When the user rotates the knob 94, the screw rod 91 is rotated relative to the sliding unit 95 and moved linearly downward or upward. By a buffer effect of the medium spring 92, the pushing lever 93 is moved with the screw rod 91 in a slower rate. Thus, the front end of the lever unit 97 is gradually lifted or lowered and drives the resistance member 98 decreases or increases the friction resistance relative to the rotating member 84. If the user wants to quickly stop the rotating member 84 as exercising, he can directly press the knob 94 to make the screw rod 91 move downward with the sliding unit 95. And then the screw rod 91 and the medium spring 92 makes the pushing lever 93 press the front end of the lever unit 97 to make the friction surface 99 of the resistance member 98 contacts the rotating member 84 closely. Thus, he can stop the rotating member 84 at short time.

Another prior embodiment of the adjustable resistance assembly takes a torsion spring (not shown in FIG. 8) to replace the recovering spring 96 as mentioned above. The torsion spring is interconnected to the rear end of the lever unit 97 and the frame 81. A recovery elasticity of the torsion spring makes the front end of the lever unit 97 tends to rotate upward. Therefore, when the user rotates the knob 94 to move the pushing lever 93 upward or looses the pressing force, the lever unit 97 can push the pushing lever 93 upward and make the resistance member 98 leave the rotating member 84. The torsion spring works as the recovering spring 96.

This kind of adjustable resistance assembly is not only applied to stationary bicycles, but also applied to exercise apparatus which can be arranged a rotating member to produce exercise resistance such as cross trainer, stepper or skiing apparatus.

Although the functions of prior adjustable resistance assemblies are not inappropriate. However, the structure relationship and components of prior adjustable assemblies are still complicated and can be simplified to reduce manufacture cost.

SUMMARY

An adjustable resistance assembly of an exercise apparatus in accordance with present invention includes a control mechanism, an elastic member and a resistance member. The control mechanism is operable connected to a frame of the exercise apparatus. There is a screw portion of the control mechanism near a rotating member of the exercise apparatus. One portion of the screw portion which is near the rotating member is coupled to a pushing portion. Another portion of the screw portion which is far away the rotating member is connected to an operating portion which allows a user to rotate the screw portion to move toward or outward the rotating member. The elastic member has a first portion, a second portion and a third portion which are located at different positions of the elastic member. The first portion of the elastic member is connected to the frame. The second portion of the elastic member can be pushed by the pushing portion to move near the rotating member therefore causes deformation of the elastic member and storages recovering elasticity. The third portion of the elastic member is connected to the resistance member. With the elastic member being deformed, the resistance member comes closer to the rotating member and presses the rotating member with a friction surface.

In the invention, the elastic member has the functions similar to the medium spring, recovering spring and the lever unit in the prior art. Therefore, the structural relationship and components of present invention is simpler than the prior art. Clearly for the forgoing reasons, there is still a need for an adjustable resistance assembly of an exercise apparatus which can be manufactured with lower cost.

DETAIL DESCRIPTION

Figure 1:
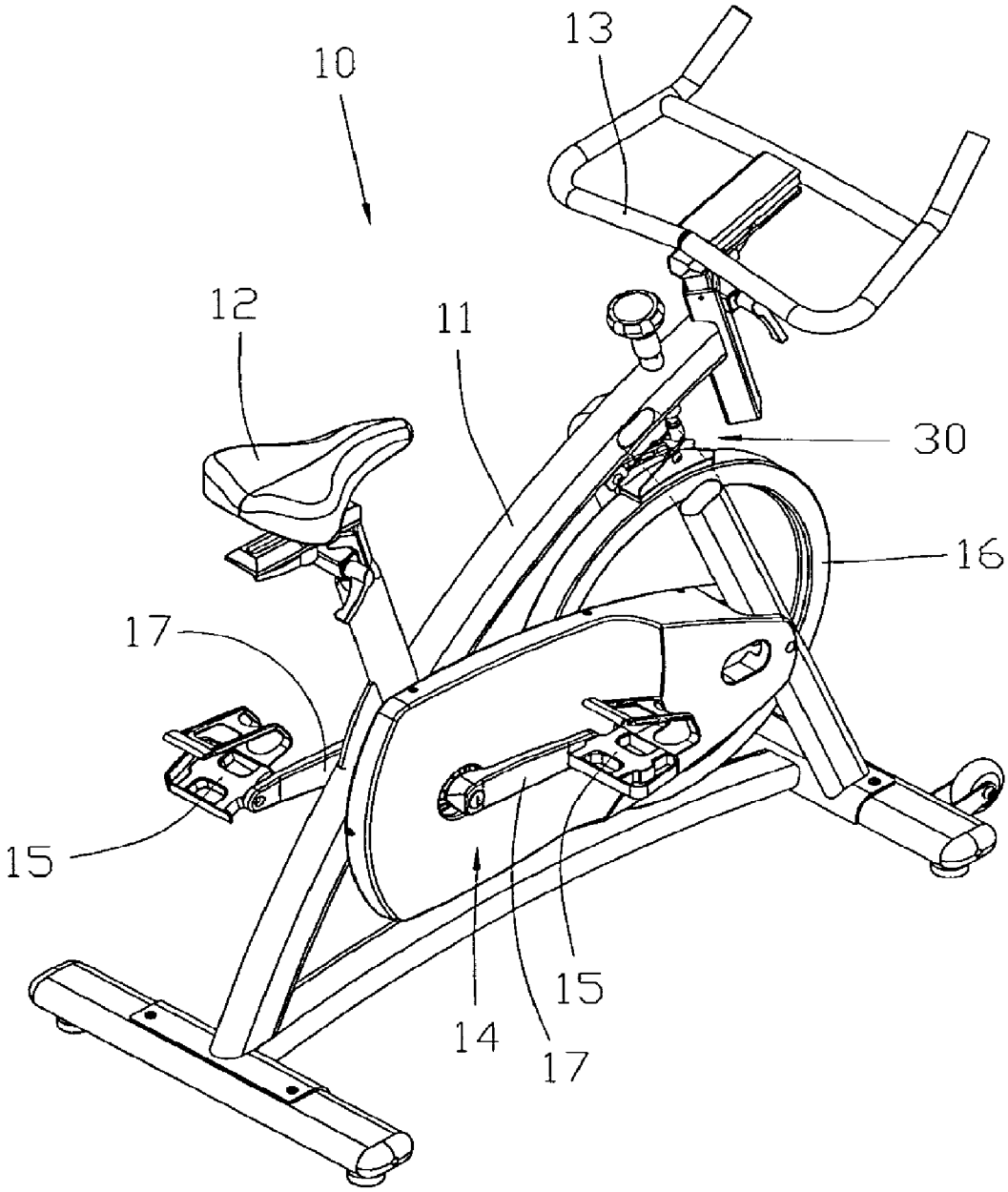
FIG. 1 is a perspective view of an adjustable resistance assembly according to a preferred embodiment applied to a stationary bicycle.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Please refer to FIG. 1, a preferred embodiment of the present invention applied to an exercise apparatus 10 is depicted. The preferred embodiment is an adjustable resistance assembly 30 applied to a stationary bicycle. However, the present invention can also be applied to other indoor exercise apparatus, such as a cross-training exercise apparatus, a stepping exercise apparatus, or a skating exercise apparatus.

The exercise apparatus 10 comprises a frame 11 adapted to rest on a floor surface and to provide a foundation for other mechanisms to couple thereto, two exercising members 14 operatively connected to the frame 11 for a user to exercise. In this embodiment, the exercising members 14 are left and right pedals 15 connected to the frame 11 via left and right cranks 17. The left and right pedals 15 allow the user to exercise as riding an outdoor bicycle. It can be appreciated by people skilled in the art that although the exercising members 14 of the preferred embodiment are left and right pedals 15 for imitating riding bicycle, other kinds of exercising members can be used depending on what kind of the exercising types are adapted, such as exercising members for running, stepping, or skating exercise.

Besides, there is a rotating member 16 pivotally connected to the frame 11. The rotating member 16 can be driven to rotate as the user using the exercising members 14. As shown in FIG. 1, the rotating member 16 is a fly wheel as people skilled in the art has already known. And, there are two pulleys (not shown) respectively coaxially coupled to the rotating member 16 and the left and right cranks 17. There is a belt or chain (not shown) wound around the pulleys. Therefore, when the user exercises, the left and right pedals 15 are capable to drive the rotating member 16 by the belt. Furthermore, in this embodiment, whatever the user rotates the left and right pedals 15 clockwise or counterclockwise, the rotating member 16 rotates in the same direction according to the left and right pedals 15 simultaneously. However, in other embodiments, the exercising members 14 may drive the rotating member 16 to rotate only in a specific direction. If the user does not rotate the exercising members 14 in the specific direction or keeps the exercising members 14 idle, he does not need to burden with the weight and the rotational inertia of the rotating member 16.

The adjustable resistance assembly 30 of the preferred embodiment is arranged higher than the rotating member 16 and behind a handgrip 13. The user can operates the adjustable resistance assembly 30 by a single hand during exercise. Please refer to FIG. 2 and FIG. 3, the adjustable resistance assembly 30 comprises a control mechanism 40 which is approximately vertically positioned, an elastic member 60 which is transversely interconnected between the frame 11 and bottom of the control mechanism 40, and a resistance member 70 connected to the elastic member 60. Top portion of the control mechanism 40 is higher than the frame 11 and allows the user to rotate or press. Bottom of the resistance member 70 is capable to press the rotating member 16 for exerting friction resistance thereon.

Figure 2:
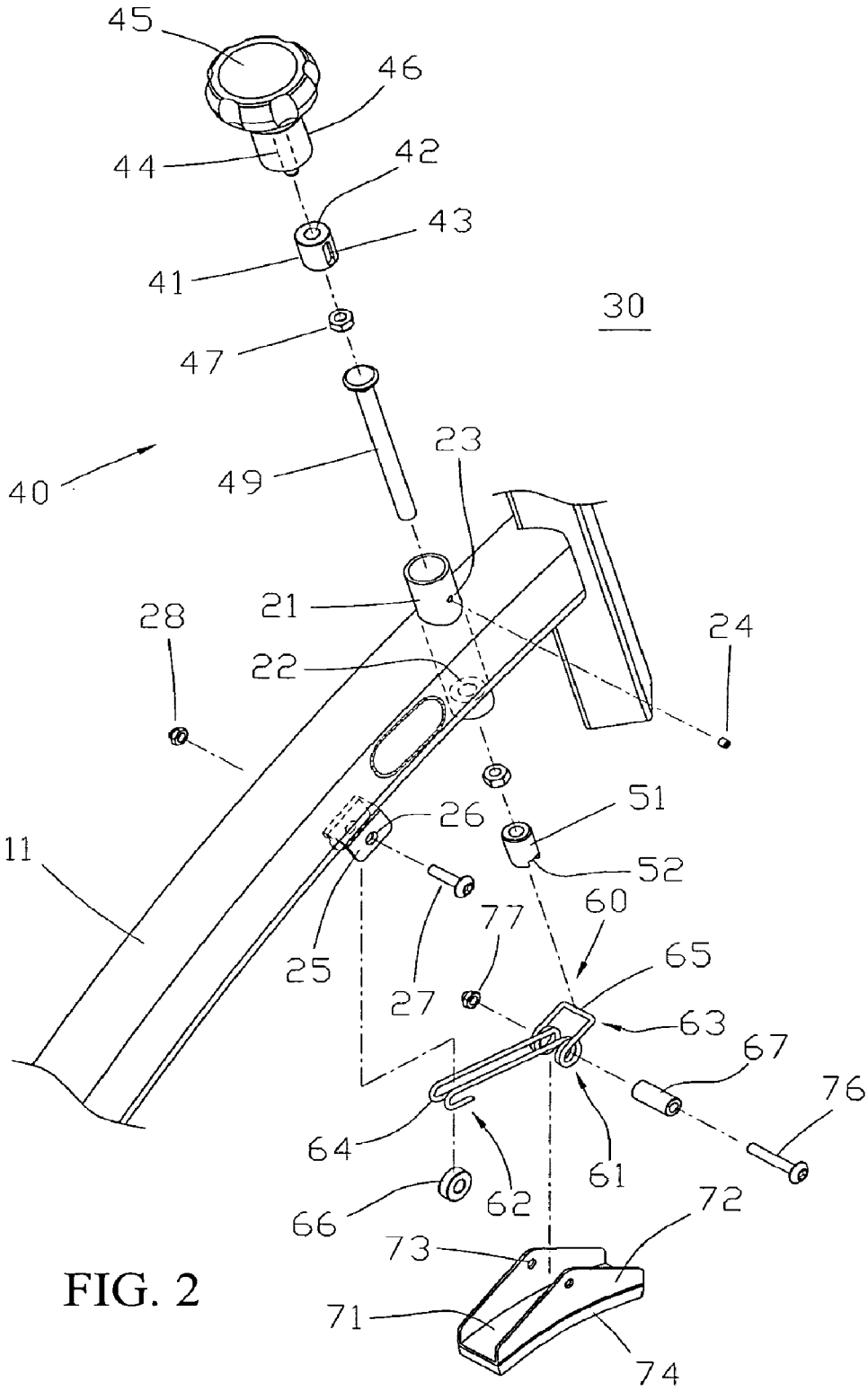
FIG. 2 is an exploded view of the adjustable resistance assembly of FIG. 1.
Figure 3:
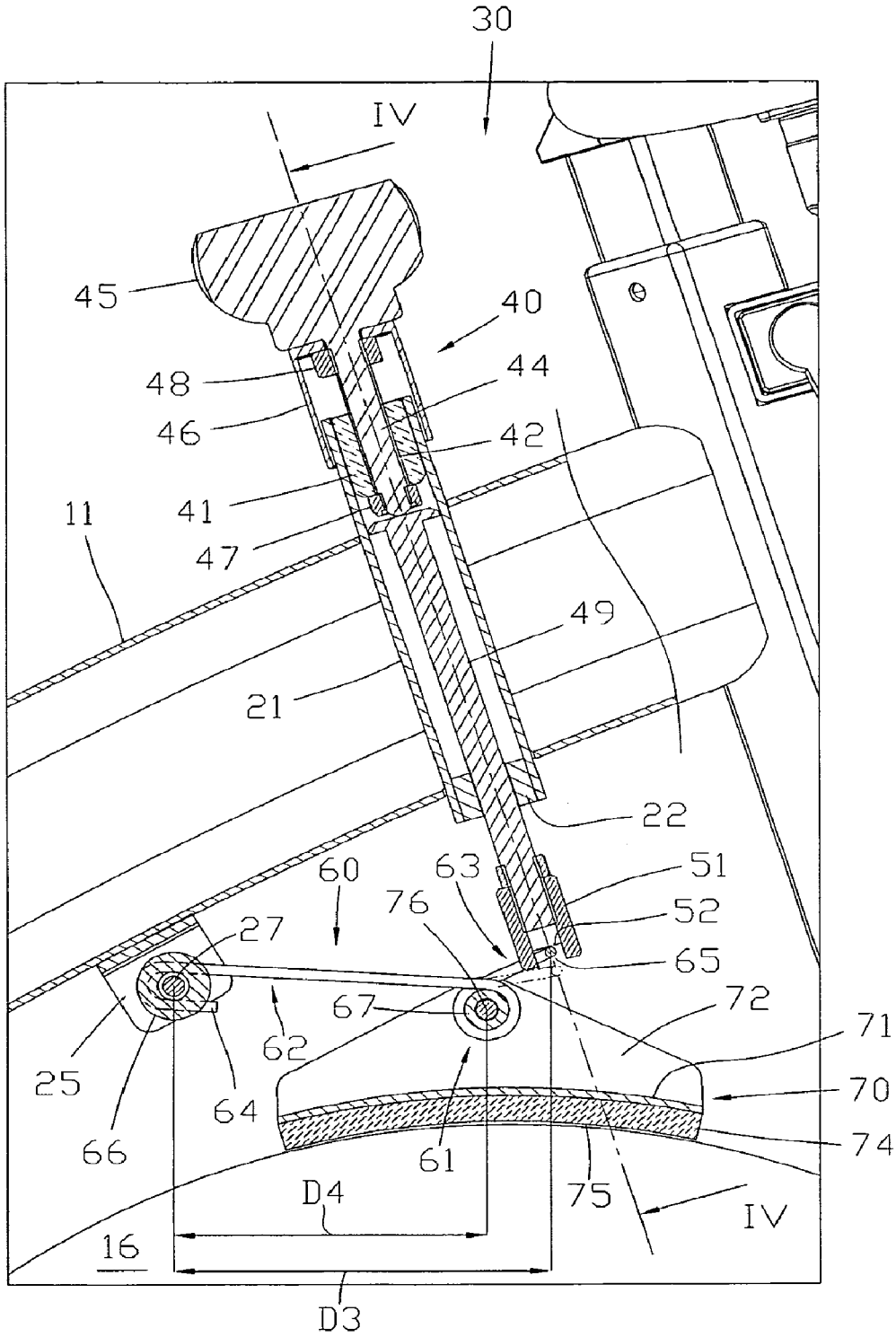
FIG. 3 is a side cutaway view of the adjustable resistance assembly showing the operation status as the user rotates the adjustable resistance assembly.

As shown in FIG. 2 and FIG. 3, there is a metallic guiding tube 21 welded on the frame 11 above the rotating member 16. Inside the guiding tube 21, there is a guiding ring 22 mounted on the lower portion of the guiding tube 21 to decrease the inner diameter of the guiding tube 21.

Now referring to the embodiment in FIG. 3, the control mechanism 40 may comprise a sliding unit 41, a screw portion 44, an operating portion 45, and a pushing portion 51 additionally having a pushing lever 49 extended upward. The sliding unit 41 is a cylinder and the diameter thereof is slightly smaller than the inner diameter of the guiding tube 21. The sliding unit 41 is coaxially accommodated in the upper portion of the guiding tube 21. Referring to FIG. 2, the sliding unit 41 has a screw hole 42 which runs through the axis of the sliding unit 41. And, the sliding unit 41 has a groove 43 on the outside surface. The length of the groove 43 is shorter than the sliding unit 41. There is a pin hole 23 on the guiding tube 21 for screwing a screw-pin 24. One distal end of the screw-pin 24 protrudes into the groove 43 of the sliding unit 41, thereby the sliding unit 41 can be moved linearly along the guiding tube 21 without rotation.

The screw portion 44 is threaded through the screw hole 42 of the sliding unit 41. Therefore, the lower portion of the screw portion 44 is inside the guiding tube 21. Relatively, the upper portion of the screw portion 44 is outside the guiding tube 21. The operating portion 45 is mounted on the top end of the screw portion 44. Because the sliding unit 41 can not rotate, the operating portion 45 can directly rotate the screw portion 44 relative to the screw hole 42 of the sliding unit 41 as the user rotating the operating portion 45. In the embodiment, there is an upper-limited nut 47 and a lower-limited nut 48 respectively disposed under and over the sliding unit 41, and respectively screwed on the lower and upper portion of the screw portion 44 for limiting the moving range of the sliding unit 41. In addition, there is a sleeve 46 clipped by the lower-limited nut 48 and the operating portion 45. The inner diameter of the sleeve 46 is larger than the outer diameter of the guiding tube 21. The sleeve 46 is configured to cover the top portion of the guiding tube 21 thereby covers part of the upper portion of the screw portion 44 outside of the guiding tube 21.

Referring to FIG. 3 again, the pushing portion 51 optionally has a lateral groove 52 opened downward. The pushing lever 49 extended from the pushing portion 51 is substantially inside the guiding tube 21. The outer diameter of the pushing lever 49 is slightly smaller than the inner diameter of the guiding ring 22 which is mounted on the lower portion of the guiding tube 21. The pushing lever 49 can be operated to move substantially upward and downward along the axis of the guiding tube 21. The top end of the pushing lever 49 is movable engaged with the bottom end of the screw portion 44, and the bottom end of the pushing lever 49 is outside the guiding tube 21.

The elastic member 60 has a first portion 62 connected to the frame, a second portion 63 coupled to the pushing portion 51, and a third portion 61. In the embodiment of FIG. 3, the elastic member 60 is a torsion spring which is made of a single steel wire. The torsion spring has a coil portion between two ends. Accordingly, the third portion 61 of the elastic member 60 is the coil portion. The first and second portions 62, 63 of the elastic member 60 are oriented in opposite directions. Therefore, the first, second, and third portions 62, 63, 61 are located in different positions of the elastic member 60. As illustrated in FIG. 2, the axis of the third portion 61 of the elastic member 60 is substantially corresponding to left-right direction. The third portion 61 is composed by two sets of coils which are apart from each other. And there are two parallel steel strips respectively extend from the coil portion. One portion of the two parallel steel strips which extend rearward forms as the first portion 62 of the elastic member 60, and the other portion extending forward forms as the second portion 63 of the elastic member 60. The distal ends of the second portion 63 are linked together which form as an engaging portion 65. Each of the distal ends of the first portion 62 is formed as a U-shaped hook 64. As depicted in FIG. 2, the length of the first portion 62 is obviously longer than the second portion 63. Because the first portion 62 of the elastic member 60 is longer, it is easier to cause elastic deformation of the first portion 62 than the second portion 63 of the elastic member 60.

The first portion 62 of the elastic member 60 is fixedly mounted on the frame 11, and the second portion 63 of the elastic member 60 is coupled to the control mechanism 40. Furthermore, in the embodiment of FIG. 3, the second portion 63 of the elastic member 60 is engaged with the groove 52 of the pushing portion 51 of the control mechanism 40 by the engaging portion 65. The first portion 62 of the elastic member 60 is screwed on two lugs 25 which are collaterally mounted on the frame 11. As shown in FIG. 2, the lugs 25 are two parallel panels. Each of the panels has a hole 26. The U-shaped hooks 64 of the first portion 62 of the elastic member 60 are arranged between the parallel panels. And there is a separated ring 66 arranged between the U-shaped hooks 64. A first screw 27 is threaded through the hole 26 of the panels, the U-shaped hooks 64, and the separated ring 66. And a first nut 28 is fastened up the end of the first screw 27 thereby fixes the first portion 62 of the elastic member 60 on the frame 11. Because the first portion 62 of the elastic member 60 is fixedly mounted on the frame 11, the first portion 62 of the elastic member 60 produces deformation when the pushing portion 51 initially pushes the second portion 63 of the elastic member 60 downward. The deformation of the first portion 62 of the elastic member 60 accumulates some energy. The accumulated energy moves the second portion 63 of the elastic member 60 upward when the pushing force from the pushing portion 51 is relieved.

Because the components are arranged as mentioned above, the elastic member 60 produces upward force to push the control mechanism 40. Furthermore, even the screw portion 44 is at the top location, the elasticity of the elastic member 60 is not exhausted. In other words, even though the upper-limited nut 47 contacts the bottom of the sliding unit 41 and the user can not keep moving the screw portion 44 up, the engaging portion 65 of the second portion 63 of the elastic member 60 is still engaged with the pushing portion 51. Therefore, the top end of the pushing lever 49 is maintained to movably contact to the bottom end of the screw portion 44 and keeps the sliding unit 41 at the top position within the moving range as shown in FIG. 3 and FIG. 4.

In the embodiment of FIG. 2 and FIG. 3, the resistance member 70 may comprises a metallic panel which includes a bottom panel 71 and left and right perpendicular panels 72, and a friction unit 74 which has a friction surface 75. There are two holes 73 respectively on the left and right perpendicular panels 72. In the embodiment, the friction unit 74 is made of fiber, such as woolens. In other embodiments, the friction unit 74 can also be made of rubber, plastic, or other materials. The friction unit 74 is fixedly mounted on the bottom of the bottom panel 71. The friction surface 75 is at bottom of the friction unit 74 and presented as an arc shape to match the surface of the rotating member 16. In some embodiment, the friction unit 74 of the resistance member 70 is optional. For example, the bottom panel 71 and perpendicular panels 72 are made of plastic. The bottom surface of the bottom panel 71 can directly press the surface of the rotating member 16 and provide sufficient friction force.

The third portion 61 of the elastic member 60 is inserted into a tube 67. There is a space between the outer diameter of the tube 67 and the third portion 61 of the elastic member 60. The length of the tube 67 is longer than the third portion 61 of the elastic member 60. The left and right perpendicular panels 72 of the resistance member 70 are respectively disposed at left end and right end of the tube 67. A second screw 76 is threaded into the hole 73 of the left and right perpendicular panels 72 and the tube 67. A second nut 77 is fastened up the end of the second screw 76 for pivotally connecting the resistance member 70 to the third portion 61 of the elastic member 60. As depicted in FIG. 3, the friction surface 75 of the resistance member 70 is closely near the rotating member 16.

Figure 4:
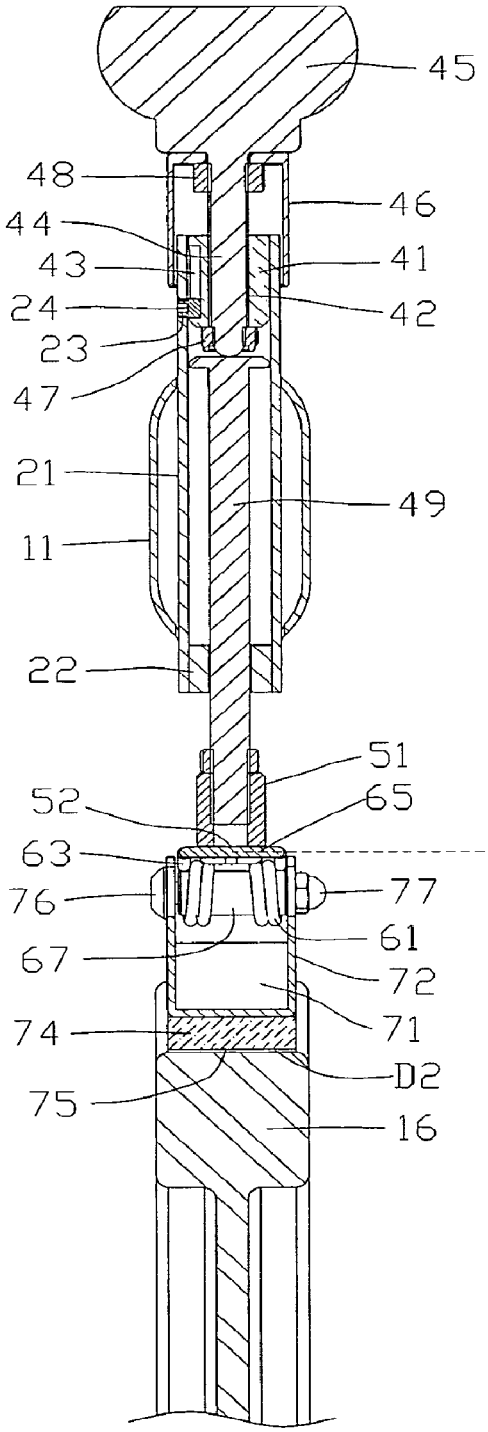
FIG. 4 is a cutaway view about the IV-IV axis of FIG. 3.

Please refer to FIG. 3 and FIG. 4, in general, the sliding unit 41 of the control mechanism 40 is located at the top position because the elastic member 60 contiguously exerting force to push up the control mechanism 40. If the user rotates the operating portion 45 to drive the screw portion 44 to rotate, the screw portion 44 is capable to resist the force which is produced by the elastic member 60. The sliding unit 41 is still approximately located at the top position because the sliding unit 41 still indirectly bears the force produced by the elastic member 60. The sliding unit 41 can not rotate as described above. In the embodiment, when the user rotates the operating portion 45 clockwise, the screw portion 44 moves downward and toward the rotating member 16. On the other hand, when the user rotates the operating portion 45 counterclockwise, the screw portion 44 moves upward and outward the rotating member 16.

When the screw portion 44 moves downward, the pushing lever 49 is pushed by the screw portion 44 and moves downward a distance simultaneously. The engaging portion 65 of the elastic member 60 is also pushed to move downward substantially the same distance. Because the elastic member 60 has elasticity and the resistance member 70 is pressed to the rotating member 16, the third portion 61 of the elastic member 60 does not move the same distance as the engaging portion 65 of the elastic member 60 does. In other words, when the second portion 63 of the elastic member 60 moves a first distance D1 toward the rotating member 16, the third portion 61 simultaneously moves a second distance D2. After the friction surface 75 pressing the rotating member 16, the second distance D2 increased is substantially zero. The first distance D1 increased will cause deformation of the elastic member 60 and produce normal force to the rotating member 16 via the resistance member 70. Because of the deformation of the elastic member 60, the ratio the first distance D1 to the second distance D2 is not proportion or equal to another ratio of a third linear distance D3 from the distal end of the second portion to the distal end of the first portion to a fourth linear distance D4 from the center of the third portion to the distal end of the first portion (FIG.3). Therefore, the current invention has a significant feature which the prior art of FIG. 8 does not have. Because of this characteristic of the elastic member 60, the ratio relationship of the first distance D1 to the second distance D2 is non-linear during the process of adjusting the adjustable resistance assembly 30. More specifically, the ratio of the first distance D1 to the second distance D2 may change after the friction surface 75 pressing the rotating member 16. With continuously increasing the first distance D1, the second distance D2 becomes harder to increase. For example, if the screw portion 44 is at the top position, the friction surface 75 of the resistance member 70 is not contacting to the rotating member 16. During the process of the screw portion 44 being rotated downward, the second portion 63 of the elastic member 60 is pushed to cause elastic deformation of the elastic member 60 and progressively inclines downward. As the phantom line shown in FIG. 3, when the screw,portion 44 continues to be rotated downward and makes the friction surface 75 of the resistance member 70 contacted the rotating member 16, the second portion 63 and the third portion 61 of the elastic member 60 starts to occur elastic deformation to absorb the pushing force. At this time, the third portion 61 of the elastic member 60 rotates clockwise and the second portion 63 of the elastic member 60 moves in a direction consistent with the rotating direction of the third portion 61 of the elastic member 60. Therefore, downward moving rate of the third portion 61 of the elastic member 60 is lower than another downward moving rate of the engaging portion 65 of the elastic member 60.

In other words, if the pitch of the screw portion 44 is 1 mm and the user rotates the screw portion 44 ten rounds, the pushing portion 51 can push the engaging portion 65 of the elastic member 60 to move downward about 10 mm. However, as described above, the resistance member 70 and the third portion 61 of the elastic member 60 may probably move downward about 2 mm. The resistance member 70 gradually stops moving toward the rotating member 16 because of the counterforce force from the rotating member 16. Instead, the first distance D1 downward is gradually transferred to some normal force against the rotating member 16. And the friction unit 74 of the resistance member 70 presses the rotating member 16 at this slower moving rate to gradually increase the friction resistance.

When the user rotates the operating portion 45 counterclockwise to move the screw portion 44 upward, the elastic member 60 can gradually recover from the elastic deformation and pushes the pushing lever 49 upward by recovering elastic force to make the top end of the pushing lever 49 keep contact with the bottom end of the screw portion 44. At the same time, the recovering process of the elastic member 60 as described above also takes the resistance member 70 to leave the rotating member 16 at a moving rate lower than another rate of the screw portion 44 being moved upward. Therefore, the friction resistance gradually decreases.

Figure 5:
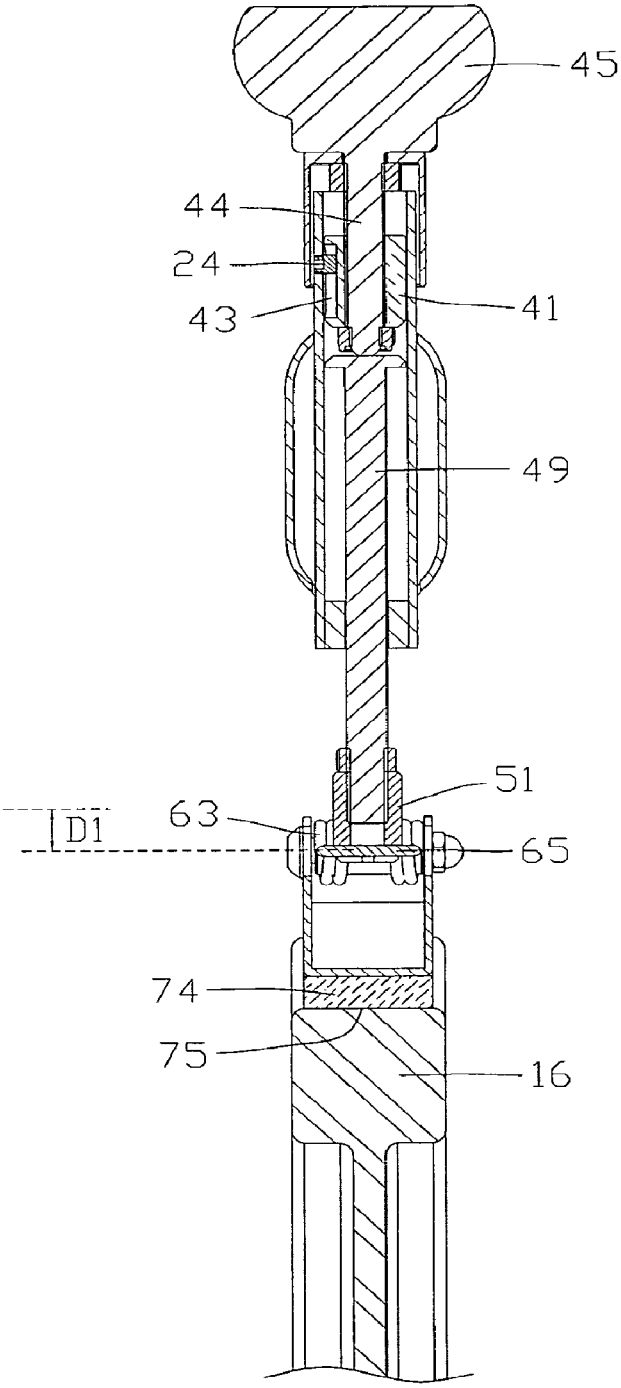
FIG. 5 is a cutaway view which is similar to FIG. 4 showing the operation status as the user operates the adjustable resistance assembly to increase friction resistance suddenly.

Besides, if the user wants to make the rotating member 16 stop immediately, he can directly push the operating portion 45 downward to make the screw portion 44, the sliding unit 41, the pushing lever 49 and the second portion 63 of the elastic member 60 directly move downward quickly. As depicted in FIG. 5, the resistance member 70 is suddenly moved downward significantly, pressing the rotating member 16 with huge friction resistance and thereby stopping the rotating member 16 immediately.

The length of the first portion 62 of the elastic member 60 is longer than the length of the second portion 63 of the elastic member 60. Because the length of the first portion 62 is longer, the first portion 62 is easier to be deformed than the second portion 63 of the elastic member 60. In contrast, the second portion 63 is harder to be deformed. Therefore, there are generally two kinds of deformations of the elastic member 60. Before the friction surface 75 contacting the rotating member 16, the main deformation of the elastic member 60 is from the first portion 62. After the friction surface 75 pressing the rotating member 16, the deformation of the elastic member 60 is mainly from the rotating deformation of the third portion 61. Such structural relationship makes the embodiment has better efficiency.

In FIG. 3, if the first portion 62 of the elastic member 60 is pivoted to the frame 11 instead of fixing thereto, the functions of adjusting the friction resistance and quickly stopping the rotating member 16 are still achievable. However, as the user rotating the operating portion 45 to move the screw portion 44 to the top position and thus to make the elastic member 60 recover to its natural status. There is no recovering elastic force to push the control mechanism 40 and the resistance member 70 upward. The elastic member 60 still burdens with the weight of the control mechanism 40 and the resistance member 70 presses on the rotating member 16 with its weight. So that, such method can not utilize the elastic member 60 to lift the resistance member 70 upward.

Figure 8:
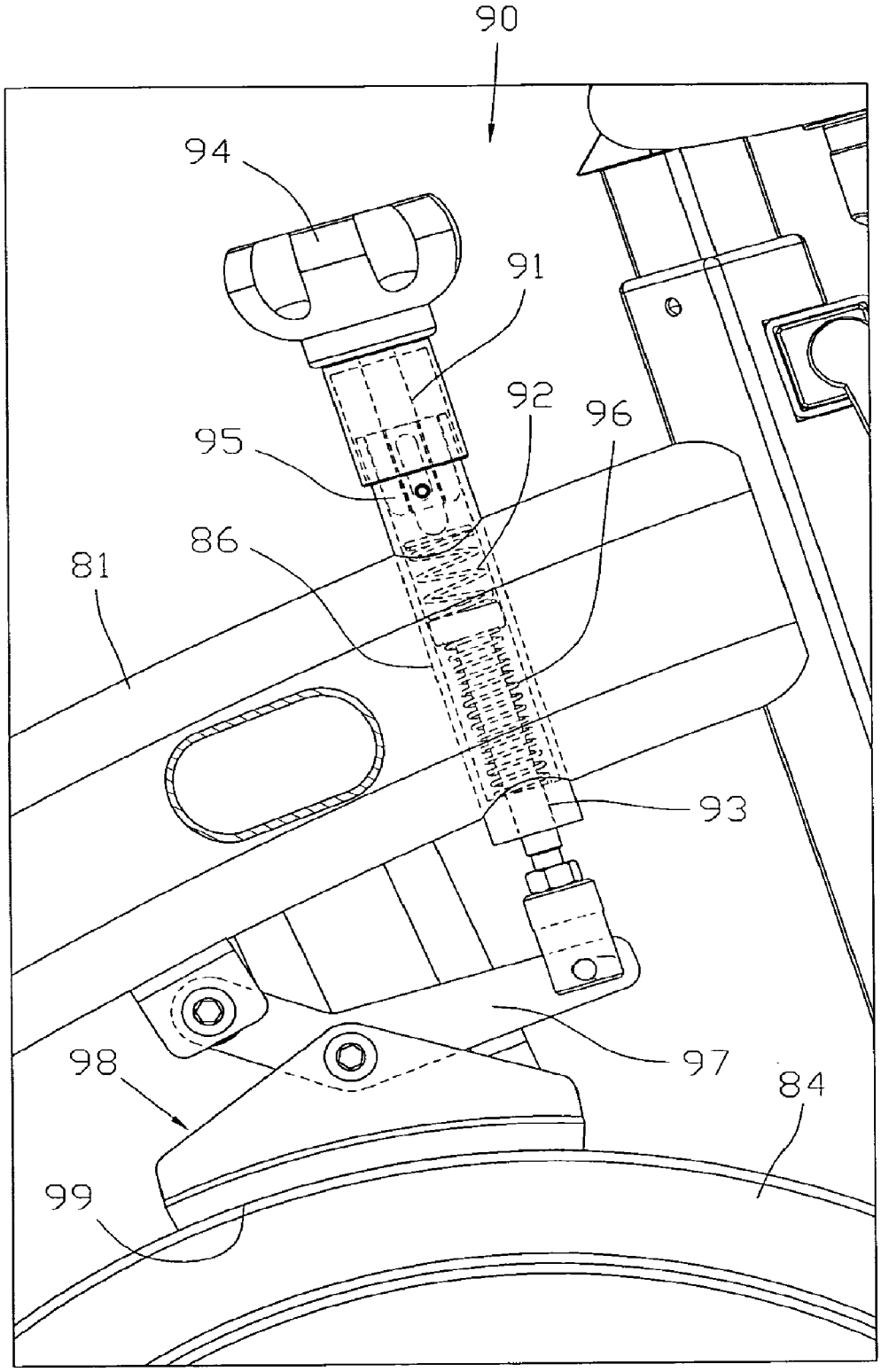
FIG. 8 (Prior Art)
FIG. 8 is side cutaway view of the adjustable resistance assembly of FIG. 7.

Referring to FIG. 3 and FIG. 8, the elastic member 60 of the adjustable resistance assembly 30 replaces the medium spring 92, recovering spring 96 and the lever unit 97. Comparing to the elastic member 60, the lever unit 97 of FIG. 8 is relatively rigid. Therefore, the structural relationship of the invention is simpler than the prior art but still has the same functions.

Figure 6:
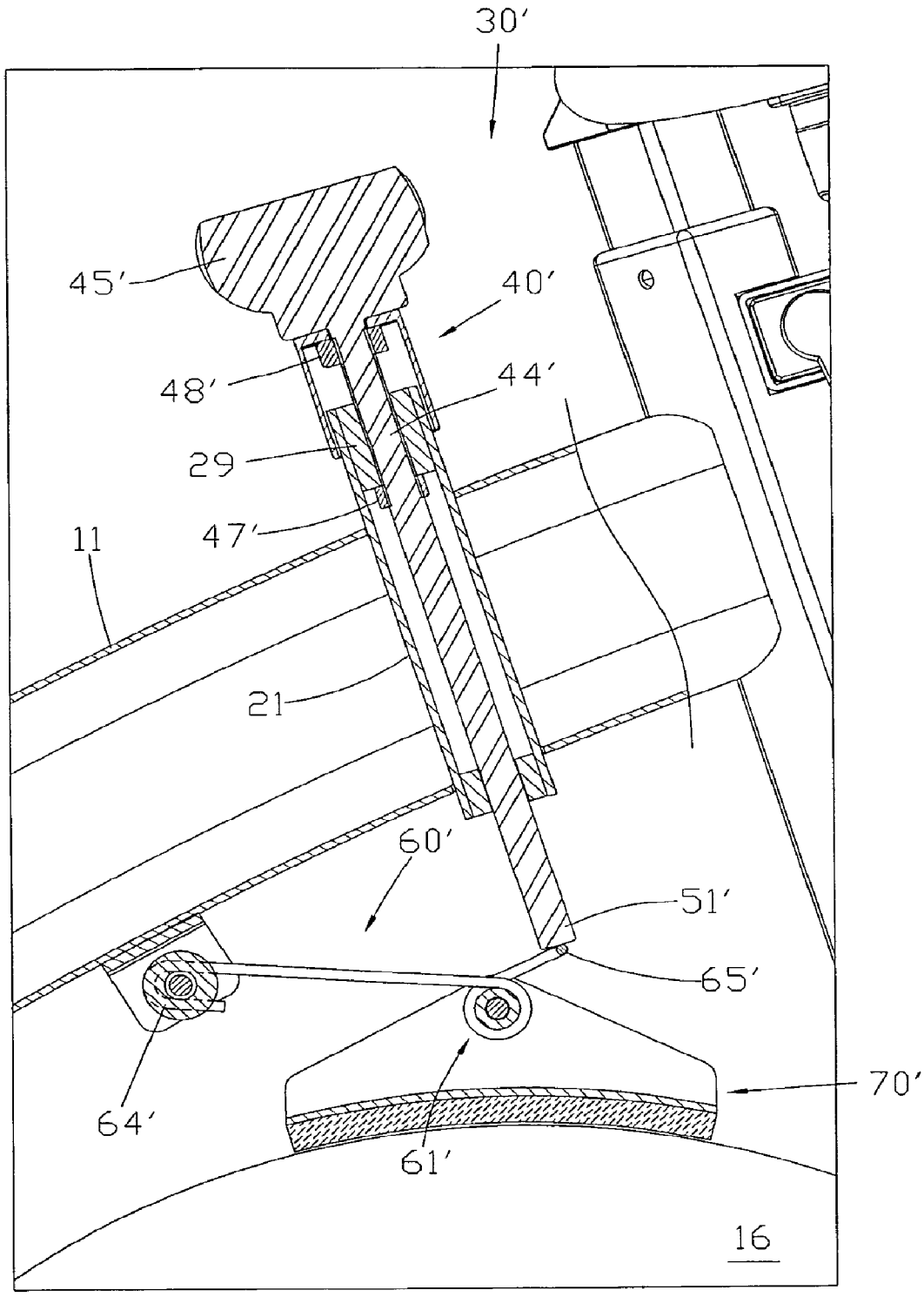
FIG. 6 is a side cutaway view of an adjustable resistance assembly according to another embodiment.
Figure 7:
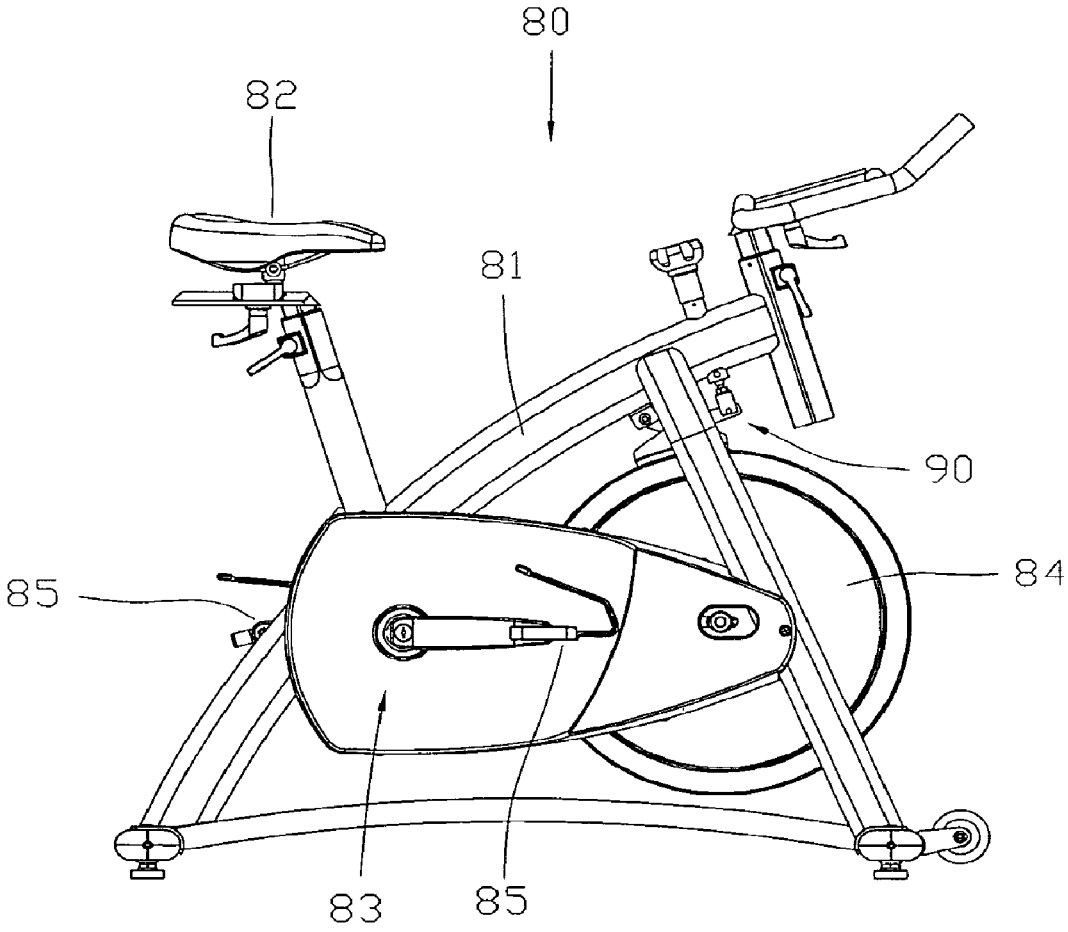
FIG. 7 (Prior Art)
FIG. 7 is a prior art showing a stationary bicycle having an adjustable resistance assembly.

FIG. 6 illustrates a second embodiment of present invention. Some difference is the second embodiment does not have the function of quickly stopping the rotating member 16. Another difference is the second embodiment has fewer parts. The second embodiment uses a screw-hole unit 29 to replace the sliding unit 41 of FIG. 3. A screw portion 44' of a control mechanism 40' is engaged with the screw-hole unit 29. The screw portion 44' of the control mechanism 40' still can be operated to rotate to move downward or upward, but can only be axially moved by rotating. Besides, the pushing portion 51' is directly extended from the lower end of the screw portion 44'. In other words, the pushing lever 49, the pushing portion 51 and the screw portion 44 of the first embodiment are combined to a single component in the second embodiment. And, an engaging portion 65' of the elastic member 60' supports the pushing portion 51' of the control mechanism 40' directly without any groove to constrain. Other structural relationship is the same with first embodiment. When the user rotates an operating portion 45' of the control mechanism 40', the whole control mechanism 40' rotates together and moves downward or upward simultaneously. A resistance member 70' which is connected to the elastic member 60' simultaneously moving close to or far away the rotating member 16 as mentioned in the first embodiment.

The present invention does not require that all the advantageous features and all the advantages need to be incorporated into every embodiment thereof. Although the present invention has been described in considerable detail with reference to certain preferred embodiment thereof, other embodiments are possible. In the invention, if the screw portion of the control mechanism can not be directly moved without rotating, such as depicted in FIG. 6, the operating portion of the control mechanism is not limited to fixedly mounted on the screw portion. Therefore, the spirit and scope of the appended claims should not be limited to the description of the preferred embodiment contained herein.

What is claimed is:

1. An adjustable resistance assembly of an exercise apparatus, the exercise apparatus comprising a frame, at least one exercising member operably connected to the frame, and a rotating member pivotally connected to the frame and driven by the exercising member, the adjustable resistance assembly comprising:

(a) a control mechanism operably connected to the frame, the control mechanism having a screw portion, an operating portion and a pushing portion, the operating portion connected to one end of the screw portion, the pushing portion extended from the other end of the screw portion, wherein the operating portion allows the user to rotate in one direction to drive the screw portion to move toward the rotating member;

(b) an elastic member including a first portion having a first distal end connected to the frame, a second portion having a second distal end coupled to the pushing portion of the control mechanism, and a coiled third portion located between the first and second portions, the pushing portion of the control mechanism pushing the second distal end of the second portion of the elastic member a first distance and moving the third portion of the elastic member a second distance toward the rotating member wherein the ratio of the first distance to the second distance is not proportional to the ratio of a third linear distance defined by the second distal end of the second portion and the first distal end of the first potion of the elastic member to a fourth linear distance defined by the third portion and the first distal end of the first portion of the elastic member wherein the elastic member is a torsion spring; and (c) a resistance member pivotally connected to the third portion of the elastic member, the resistance member having a friction surface faced to the rotating member, as the elastic member moved, the friction surface of the resistance member exerted friction resistance on the rotating member.

2. The adjustable resistance assembly of claim 1, wherein the second distal end of the second portion of the elastic member forms an engaging portion and the first distal end of the first portion of the elastic member forms a U-shaped hook.

3. The adjustable resistance assembly of claim 1, wherein the first distal end of the first portion of the elastic member is fixedly mounted on the frame.

4. The adjustable resistance assembly of claim 1, wherein the length of the first portion is longer than the length of the second portion of the elastic member.

5. The adjustable resistance assembly of claim 1, the control mechanism further comprising a pushing lever extended from the pushing portion and engaged to the screw portion of the control mechanism.

6. The adjustable resistance assembly of claim 1, the control mechanism further comprising a sliding unit which has a screw hole for the screw portion of the control mechanism being screwed therein, wherein the sliding unit is slidably mounted to the frame.

7. An exercise apparatus, comprising:

(a) a frame;

(b) an exercising member operably connected to the frame;

(c) a rotating member pivotally connected to the frame wherein the rotating member is driven by the exercising member; and (d) an adjustable resistance assembly comprising a control mechanism, an elastic member, and a resistance member, wherein the control mechanism operably connected to the frame, the control mechanism having a screw portion, an operating portion and a pushing portion, the operating portion connected to one end of the screw portion, the pushing portion extended from the other end of the screw portion, wherein the operating portion allows the user to rotate in one direction to drive the screw portion to move toward the rotating member;

the elastic member, including a first portion having a first distal end connected to the frame, a second portion having a second distal end coupled to the pushing portion of the control mechanism, and a third portion located between the first and second portions, the pushing portion of the control mechanism pushing the second distal end of the second portion of the elastic member a first distance and moving the third portion a second distance toward the rotating member wherein the ratio relationship of the first distance to the second distance is non-linear wherein the elastic member is a torsion spring; and the resistance member directly connected to the third portion of the elastic member, the resistance member having a friction surface faced to the rotating member, as the elastic member moved, the friction surface of the resistance member exerted friction resistance on the rotating member.

8. An adjustable resistance assembly of an exercise apparatus, the exercise apparatus comprising a frame, at least one exercising member operably connected to the frame, and a rotating member pivotally connected to the frame and driven by the exercising member, the adjustable resistance assembly comprising:

(a) a control mechanism operably connected to the frame, the control mechanism having a screw portion, an operating portion and a pushing portion, the operating portion connected to one end of the screw portion, the pushing portion extended from the other end of the screw portion, wherein the operating portion allows the user to rotate in one direction to drive the screw portion to move toward the rotating member, (b) an elastic member including a first portion having a first distal end connected to the frame, a second portion having a second distal end coupled to the pushing portion of the control mechanism, and a third portion located between the first and second portions, the pushing portion of the control mechanism pushing the second distal end of the second portion of the elastic member a first distance and moving the third portion of the elastic member a second distance toward the rotating member wherein the ratio of the first distance to the second distance is not proportional to the ratio of a third linear distance defined by the second distal end of the second portion and the first distal end of the first potion of the elastic member to a fourth linear distance defined by the third portion and the first distal end of the first portion of the elastic member; and (c) a resistance member directly pivoted to the third portion of the elastic member, the resistance member having a friction surface faced to the rotating member, as the elastic member moved, the friction surface of the resistance member exerted friction resistance on the rotating member.

9. The adjustable resistance assembly of claim 8, wherein the length of the first portion of the elastic member is longer than the length of the second portion of the elastic member.

10. The adjustable resistance assembly of claim 8, wherein the elastic member is a torsion spring and the third portion of the elastic member is coiled.

* * * * *